US007812732B1

(12) United States Patent
Brouillard

(10) Patent No.: US 7,812,732 B1
(45) Date of Patent: Oct. 12, 2010

(54) WATER SAFETY APPARATUS

(76) Inventor: Aloysius Brouillard, 1800 Homestead Ct., Little Chute, WI (US) 54140

( * ) Notice: Subject to any disclaimer, the term of this patent is extended or adjusted under 35 U.S.C. 154(b) by 309 days.

(21) Appl. No.: 12/157,486

(22) Filed: Jun. 11, 2008

Related U.S. Application Data

(60) Provisional application No. 60/967,947, filed on Sep. 7, 2007.

(51) Int. Cl.
*G08B 23/00* (2006.01)

(52) U.S. Cl. ..... 340/573.6; 441/11; 116/173

(58) Field of Classification Search ..... 340/573.1, 340/573.5, 573.6, 573.7; 441/11, 88, 89, 441/90; 116/173, 209
See application file for complete search history.

(56) References Cited

U.S. PATENT DOCUMENTS

| | | | | |
|---|---|---|---|---|
| 3,104,644 | A | 9/1963 | Burton | |
| 4,035,856 | A | 7/1977 | Oberg | |
| 4,144,606 | A * | 3/1979 | McIntyre | 441/11 |
| 4,598,661 | A | 7/1986 | Roe | |
| 5,029,551 | A | 7/1991 | Rosen | |
| 5,083,956 | A | 1/1992 | Chraghchian et al. | |
| 5,114,369 | A | 5/1992 | Coffey | |
| 5,423,282 | A | 6/1995 | Krull et al. | |
| 5,893,786 | A | 4/1999 | Stevens | |
| 6,749,473 | B1 | 6/2004 | Lower | |
| 7,056,179 | B2 * | 6/2006 | Courtney | 441/90 |
| 2004/0157514 | A1 * | 8/2004 | Courtney | 441/88 |

* cited by examiner

*Primary Examiner*—Van T. Trieu
(74) *Attorney, Agent, or Firm*—Brannen Law Office, LLC

(57) ABSTRACT

The apparatus of the present invention has a shell, an indicator and straps. The shell has flanges at the top and bottom, respectively, constricting the hole size at the ends of the shell. The shell can be comprised of a body and a cap. The indicator is in telescoping engagement with the shell. The indicator has two ends. The first end of the indicator protrudes from the second end of the shell. A weight is at the second end of the indicator. The weight has a sidewall with an outer periphery greater in size than the inner periphery of the shell ends. The straps are used to secure the apparatus to a person. The indicator extends from the shell when the person enters the water. The indicator, aided by the weight, retracts into the shell when the person exits the water. The shell can have wings.

20 Claims, 12 Drawing Sheets

WATER SAFETY APPARATUS

This utility patent application claims priority on and the benefit of provisional application 60/967,947 filed Sep. 7, 2007, the entire contents of which are hereby incorporated herein by reference.

BACKGROUND OF THE INVENTION

1. Field of the Invention

The present invention relates to water safety apparatus and in particular to a device wearable about a user and having a water activated indicator for alerting others of a person in the water.

2. Description of the Related Art

Boats and other types of watercraft can pose threats to persons in the water. People who water ski, ride on tubes or are just swimming in a lake or body of water can be at risk of being unnoticed by passing boats or other watercraft. Typically, when a person is water skiing, they wear a floatation vest. While the floatation vest works well for its intended purpose (to keep the head of the wearer above water), the user still may not be visible to an approaching boat. This problem may be exacerbated by the fact that, in circling around to pick up the downed skier, some tow boats are several hundred yards from the swimmer.

Fortunately, several products have been invented to assist in alleviating this problem. While each of the products described in the following patents may work well for their intended purposes, each can be improved upon.

U.S. Pat. No. 5,893,786 to Stevens is titled Automatic Telescoping Buoyant Identification Device for Use with a Water Spout Life Vest. The Stevens patent shows a spotting pole that is constructed of buoyant foam. The pole slides freely within a tubular main housing. The spotting pole is described to automatically telescope from the main housing into the air when the wearer becomes submerged in water. A spotting pole flange is disclosed to come into a mechanical interference with either of two main housing flanges.

U.S. Pat. No. 5,083,956 to Chraghchian et al. is titled Water Warning Device. The Chraghchian et al. patent discloses a self elevating signaling device for water skiers. An enlarged visual luminescent marker having an outer guide tube and a buoyant tube freely mounted inside the guide tube is secured to a flotation jacket. A curved flange (number 42) is provided for guiding the floatation tube into the guide tube.

U.S. Pat. No. 5,029,551 to Rosen is titled Safety Device to Increase the Visibility of Persons Afloat in the Water. The Rosen patent teaches an automatically activated device for increasing the visibility of a person floating in the water. An inflatable flag assembly is shown to be within a circular housing which is pivotally connected to a plate. The pivotal connections maintain the flag assembly in the vertical posture even as the wearer bobs in the water.

Some other patents include:

| U.S. Pat. No. | Inventor | Title |
|---|---|---|
| 6,749,473 | Lower | Extensible Safety Signal Device |
| 5,423,282 | Krull et al. | Signal for Indicating Location of Floating Person |
| 5,114,369 | Coffey | Water Skier's Safety System |
| 4,598,661 | Roe | Safety Signal Device |
| 4,035,856 | Oberg | Water Ski Safety Flag |
| 3,104,644 | Burton | Water Skier Safety Device |

None of these patents show a telescopic indicator having a weighted end remaining within a shell. Accordingly, none of these patents show a water safety apparatus having immediate response upon the user being submerged in the water and the user rising from the water.

Some of the patents show the use of flags or the like. While flags may be useful in some circumstances, their use can have unintended drawbacks. For example, the use of a flag can increase drag on the apparatus, and if the drag is sufficient, can cause the indicator to extend even though the apparatus is out of the water. This can leave the indicator vulnerable to damage if it is extended as the person falls into the water. The extended indicator can also pose a hazard to others if multiple people are, for example, tubing simultaneously.

Thus there exists a need for a water safety device that solves these and other problems.

SUMMARY OF THE INVENTION

The present invention relates to water safety apparatus and in particular to a device wearable about a user and having a water activated indicator for alerting others of a person in the water. In a preferred embodiment, the apparatus has a shell, an indicator and straps. The shell has flanges at the top and bottom, respectively, constricting the hole size at the ends of the shell. The indicator is in telescoping engagement with the shell. The indicator has a first end and a second end. The first end of the indicator protrudes from the first end of the shell. A weight is at the second end of the indicator. The weight has a sidewall with an outer periphery greater in size than the inner periphery of the shell ends. The straps are used to secure the apparatus to a person. The indicator extends from the shell when the person enters the water. The indicator, aided by the weight, retracts into the shell when the person exits the water. In one embodiment, the indicator can have wings.

According to one advantage of the present invention, the indicator is telescopically connected to the shell. Advantageously, the indicator rises from the shell when the apparatus enters the water, and the indicator retracts into the shell when the apparatus exits the water.

According to another advantage of the present invention, the indicator stores nicely within the shell when the user is out of the water. Advantageously, the end of the indicator extends only a limited amount from the shell when not extended. Any drag on the end of the indicator is therefore minimized.

According to a further advantage of the present invention, the apparatus is light weight and comfortable. In this regard, the use of the device should not inconvenience any user, which may limit its use.

According to a still further advantage yet of the present invention, the indicator can be made of an inflatable plastic material. This advantageously yields an indicator that is extremely light, is bendable and thus safe, and is highly buoyant. Safety is of particular importance in situations where multiple riders are skiing or tubing simultaneously. This is accomplished by eliminating a hard surface that can strike a third person.

According to a still further advantage yet of the present invention, the water safety apparatus has a weighted end within the shell. This advantageously allows the indicator remain fully retracted when the apparatus is out of the water. Yet, it is understood that the buoyancy force caused by the water displacing the tube is strong enough to cause the indicator to extend when the apparatus enters the water.

According to a still further advantage yet of the present invention, the water safety apparatus has an indicator with a low profile. Accordingly, the end of the indicator projecting from the shell during a retracted state will have low wind resistance. Accordingly, the indicator will remain retracted when the user is out of the water without the need for mechanical latching devices.

According to a still further advantage yet of one embodiment of the present invention, the shell has a winged structure. This structure has a rounded outer perimeter that is unlikely to cause injury, and also provides a large surface for advertising materials. In particular, the advertising surface can be an arched surface viewable from the rear and both sides.

Other advantages, benefits, and features of the present invention will become apparent to those skilled in the art upon reading the detailed description of the invention and studying the drawings.

DETAILED DESCRIPTION OF THE PREFERRED EMBODIMENTS

Figure 1:
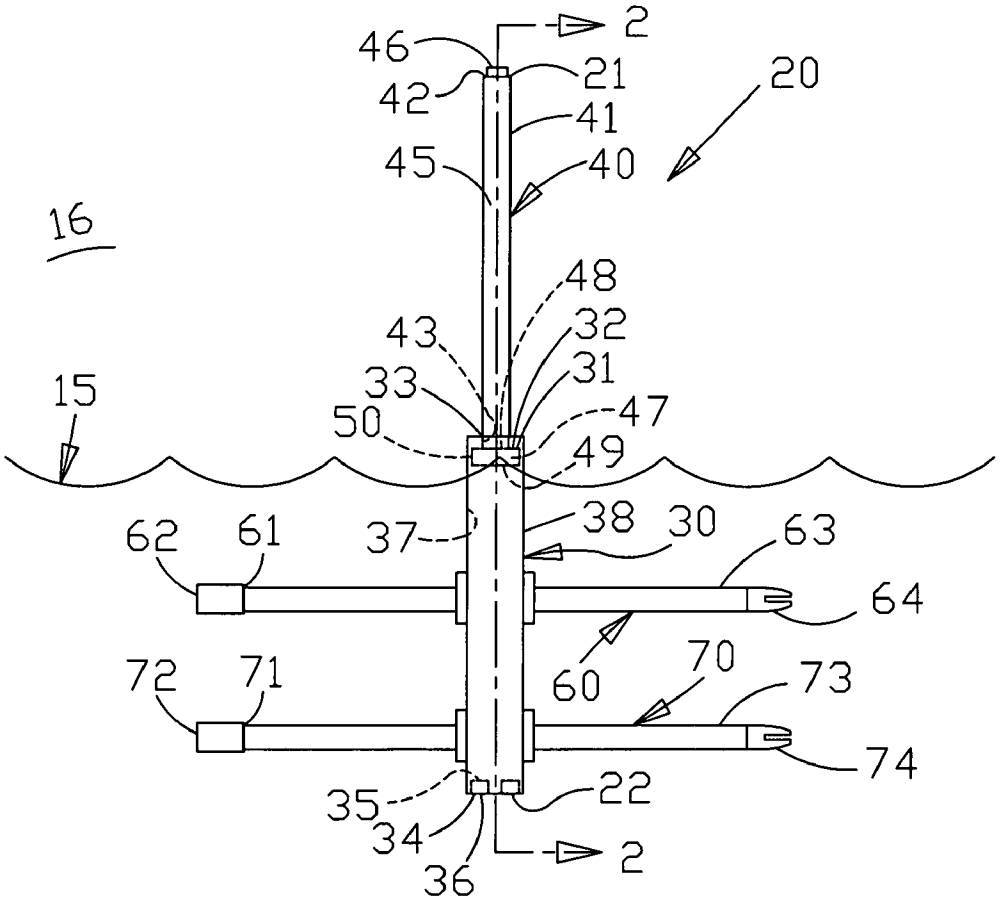
FIG. 1 is a side view of a preferred embodiment of the present invention, showing the apparatus in the extended position.

While the invention will be described in connection with several preferred embodiments, it will be understood that it is not intended to limit the invention to those embodiments. On the contrary, it is intended to cover all alternatives, modifications and equivalents as may be included within the spirit and scope of the invention as defined by the appended claims.

The present invention is intended for use with a person 10. A person 10, or user, has a torso 11, arms 12 and a head 13. The user 10 can play in or around bodies of water 15. Portions of the user 10 may be submerged within the water 15, or may extend up from the water 15 into the air 16.

Figure 2:
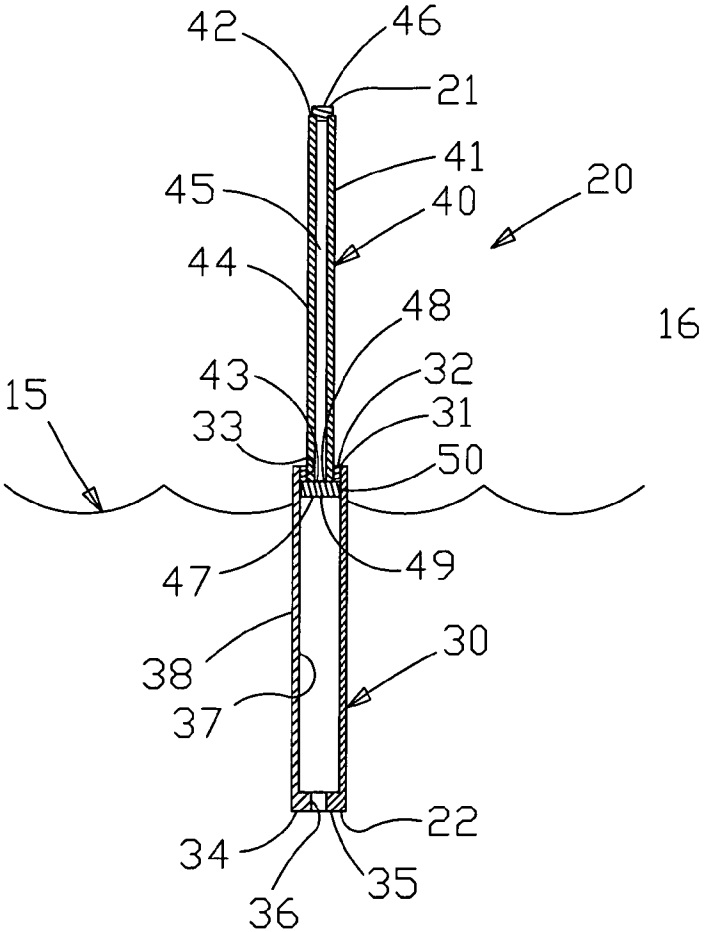
FIG. 2 is a cross-sectional view of the preferred embodiment shown in FIG. 1 and taken along line 2-2 in FIG. 1.
Figure 3:
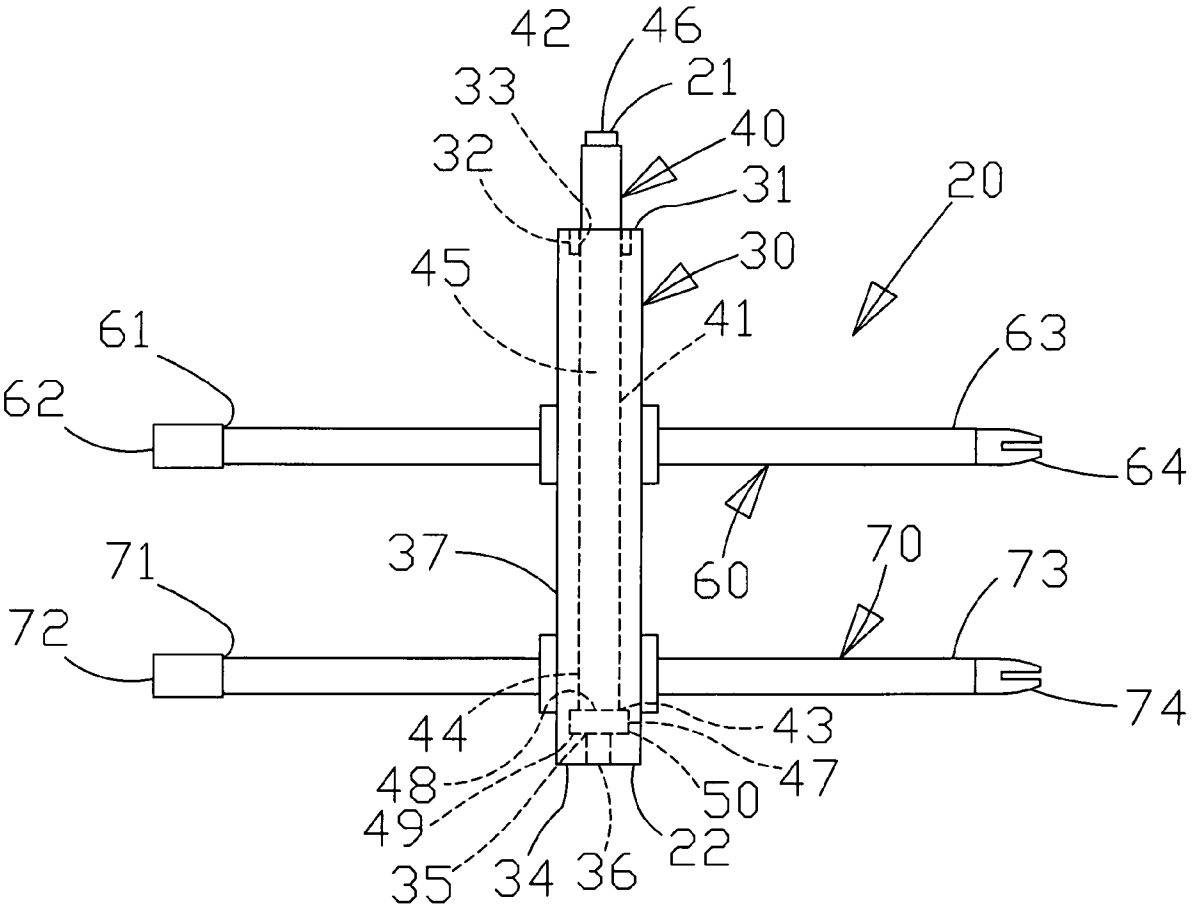
FIG. 3 is a side view of the preferred embodiment shown in FIG. 1, but in the retracted position.

Turning now to FIGS. 1-3, an apparatus 20 is shown having a top 21 and a bottom 22. The apparatus 20 preferably has several components, described in detail below. Those components include a shell 30, an indicator 40 and straps 60 and 70.

Figure 6:
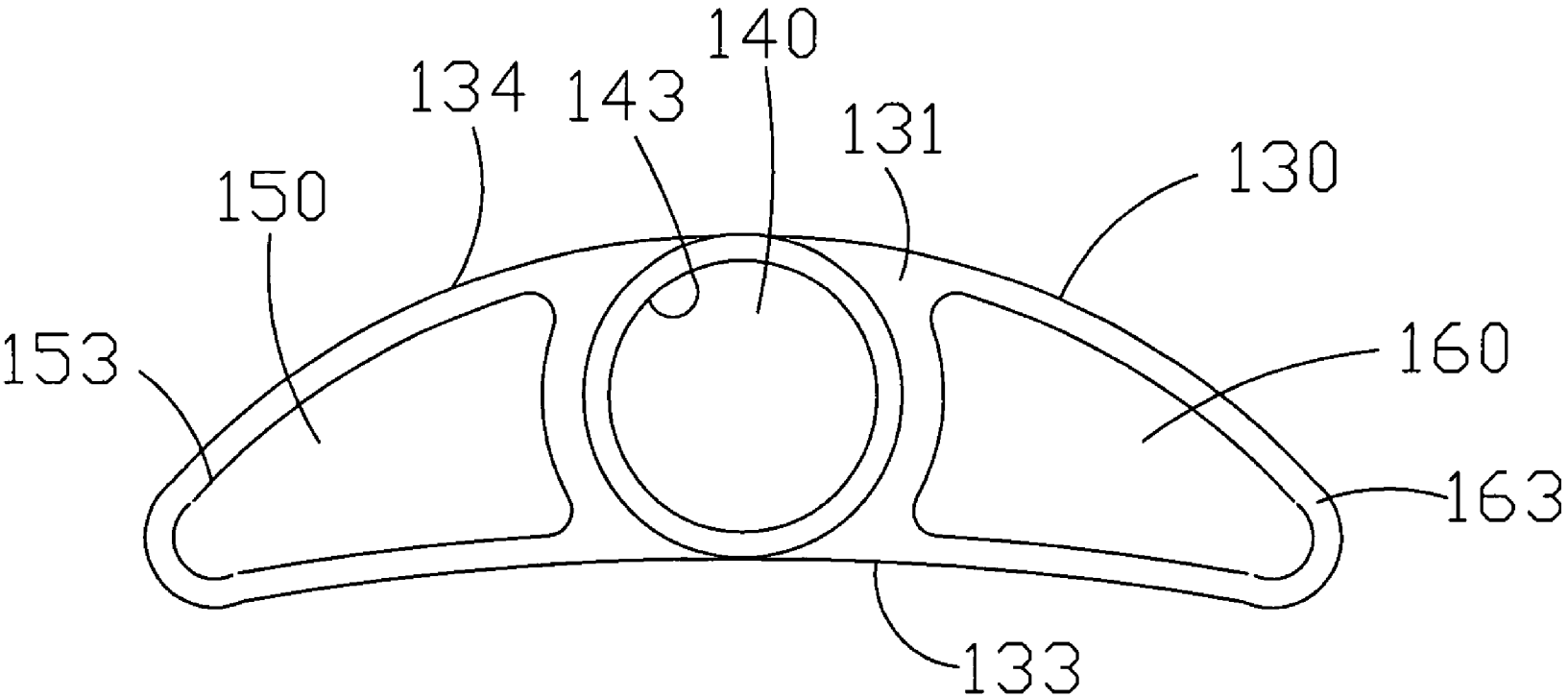
FIG. 6 is a top view of an alternative embodiment of the shell of the present invention.
Figure 7:
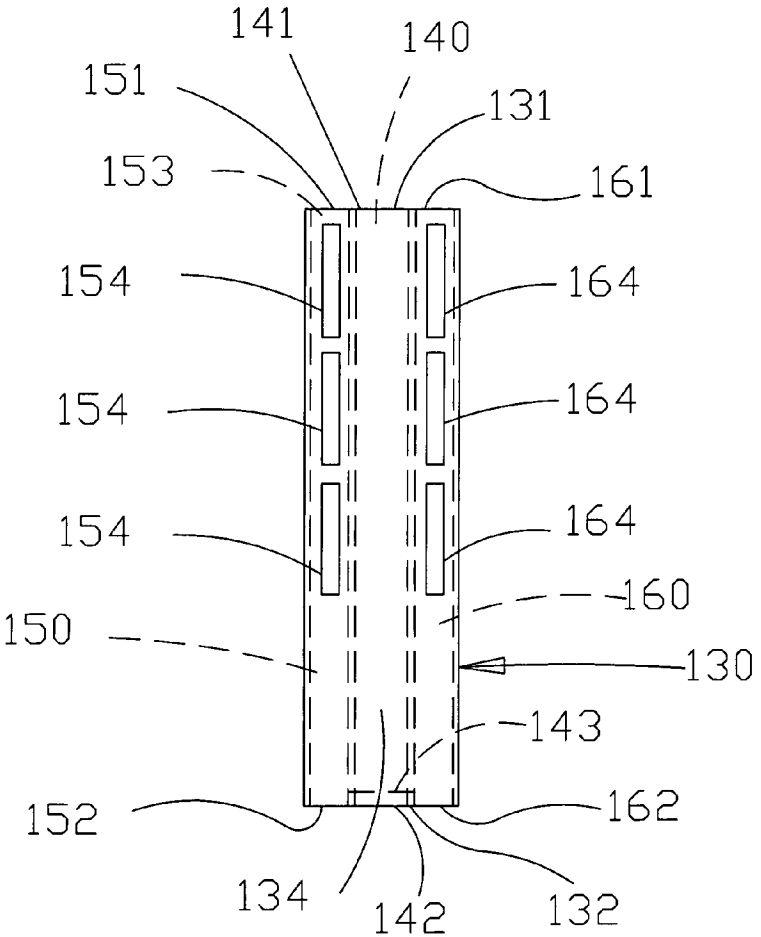
FIG. 7 is a side view of the embodiment of the shell shown in FIG. 6.

Shell 30 is preferably a hollow thin walled plastic shell. The shell can have a length of approximately 2-3 feet. Yet, it is understood that the shell 30 could be longer or shorter without departing from the broad aspects of the present invention. The shell 30 has a top 31 and a bottom 34. A flange 32 is at the top of the shell. The shell 30 is open at the top 31, and the flange 32 constricts the size of the opening 33 or hole. A flange 35 is also at the bottom 34 of the shell 30. The shell 30 is open at the bottom 34, and the flange constricts the size of the opening 36. It is preferable, for reasons apparent below, that either or both of the top 31 or bottom 34 are removable from the shell 30. The wall of the shell 30 has an inside 37 and an outside 38. The shell preferably has a generally circular interior periphery. Yet, it is appreciated alternative shapes can be utilized without departing from the broad aspects of the present invention. For example, a shell 130 with an oblong shape is provided in FIG. 6, which can have a relatively flat back. The shape of the shell 130 can have a wing on each side.

Indicator 40 preferably has a tube 41 that is inflatable through valve 46, and a weight 47. The tube 41 has a top 42 and a bottom 43. The outer perimeter of the tube 41 is defined by wall 44. The tube is preferably an inflatable tube, and as such is inflated with air 45. The tube 41 can be inflated or deflated through valve 46. Valve 46 is preferably located at the top 42 of tube 41 to facilitate inflation and deflation of the tube 41. The buoyancy of the tube 41 increases with the inflation of the tube. The indicator 40 preferably has a round periphery to facilitate movement within the shell 30.

A weight 47 is provided and can be connected to the bottom 43 of the tube 41. The weight 47 has a top 48 and a bottom 49. The weight 47 also has a sidewall 50, which preferably has a generally circular periphery. The periphery of sidewall 50 is preferably greater than the interior periphery of holes 33 and 36 at the top and bottom 31 and 34, respectively, of shell 30. The periphery of sidewall 50 is preferably smaller than the interior periphery of shell 30. In this regard, the weight 47 is free to move about within the shell 30 between the ends 31 and 34, but is incapable of exiting the shell 30 through either end. Thus it is apparent why one of the ends of the shell 30 is preferably removable.

A first strap 60 is provided, and is shown in the preferred embodiment to be connected to the outside 38 of the shell 30. The strap 60 has a first end 61 with a first buckle piece 62, and a second end 63 with a second buckle piece 64. It is understood that the buckle pieces 62 and 64 are mating buckle pieces that can easily be fastened and unfastened.

A second strap 70 is further provided. The second strap 70 has a first end 71 with a first buckle piece 72, and a second end 73 with a second buckle piece 74. It is understood that the buckle pieces 72 and 74 are mating buckle pieces that can easily be fastened and unfastened.

It is appreciated that alternative strapping may be incorporated without departing from the broad aspects of the present invention. Further, it is appreciated that the strapping can be incorporated into or embedded into a traditional floatation jacket without departing from the broad aspects of the present invention.

Figure 5:
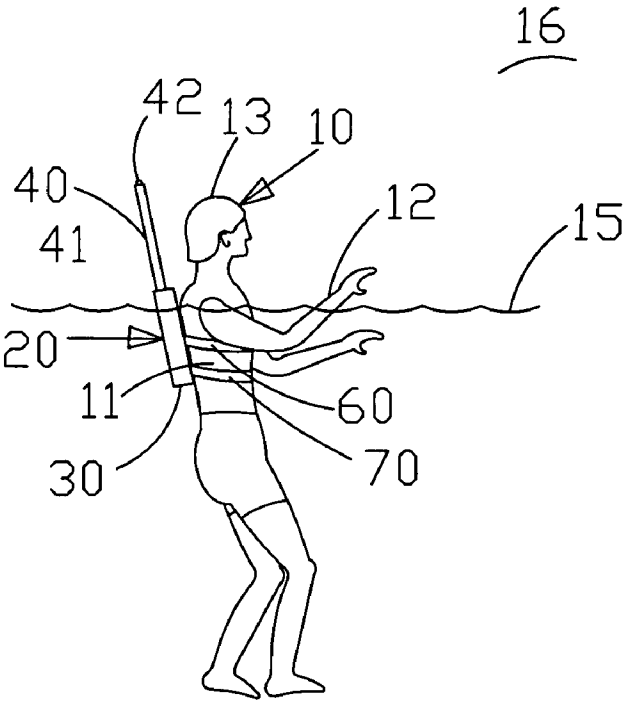
FIG. 5 is a side view of a person wearing the embodiment of the present invention shown in FIG. 1 wherein the person is submerged in the water and the indicator is extended.
Figure 4:
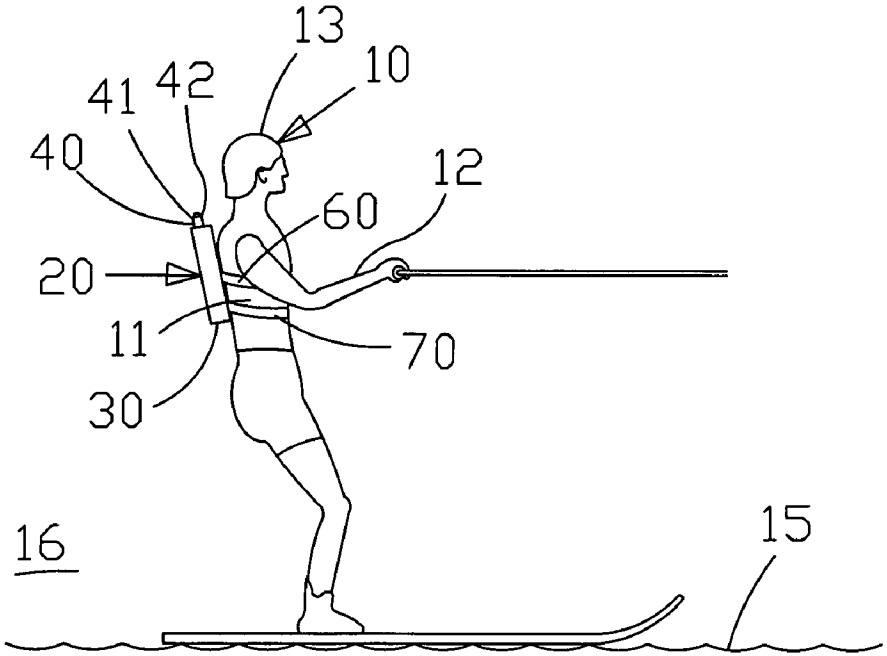
FIG. 4 is a side view of a person wearing the embodiment of the present invention shown in FIG. 1 wherein the person is out of the water and the indicator is retracted.

Calling attention now to FIGS. 4 and 5, the operation of the present invention is illustrated. In FIG. 4, when the person 10 is out of the water, the apparatus 20 is fully out of the water and within the air 16. The weight 47 at the bottom 43 of the indicator 40 causes the tube 41 to remain retracted within the shell 30, such that the bottom 49 of the weight 47 is adjacent the flange 35 at the bottom of the shell 30.

When the person 10 is submerged in the water 15, as shown in FIG. 5, the water rushes into the hole 36 at the bottom of the shell 30. The force due to the buoyancy of the inflatable tube 41 is enough to overcome the force of the weight 47 causing the tube 41 to telescopically extend from the shell 30. In the fully extended position, the top 48 of the weight 47 is adjacent the flange 32 at the top 31 of the shell 30. The top 42 of the tube 41 of the indicator 40 rises above the head 13 of the user 10 enabling the indicator 40 to be viewed from all directions. The indicator 40 is preferably brightly colored to attract attention.

Turning now to FIGS. 6-15, an alternative embodiment of the apparatus 120 is shown having a top 121 and a bottom 122. The apparatus 120 preferably has several components, described in detail below. Those components are a shell 130, an indicator 240 and a jacket 270.

Shell 130 is preferably a hollow thin walled plastic shell. The shell can have a length of approximately 1-3 feet. In the illustrated embodiment, the shell 130 has a height of approximately 16 inches. Yet, it is understood that the shell 130 could be longer or shorter without departing from the broad aspects of the present invention. The shell 130 has a top 131 and a bottom 132. Shell 130 further has a back 133 and a front 134. A central chamber 140 is provided having a top 141 and a bottom 142. Chamber 140 has an internal diameter. A lip 143 is provided at the bottom 142. The lip has an internal diameter that is smaller than the internal diameter of the chamber 140. The central chamber 140 preferably has a round internal diameter, and has a central axis.

A first wing chamber 150 is provided. The wing chamber 150 has a top 151 and a bottom 152. A lip is provided at the bottom. The lip 153 has dimensions smaller than the internal diameter of the wing chamber 150. The first wing chamber 150 preferably has a central axis. Several openings 154 are provided into the chamber 150 from the front side 134 of the shell. The openings 154 are water permeable, and aid in alleviating any pressure from developing within the wing chamber.

A second wing chamber 160 is provided. The wing chamber 160 has a top 161 and a bottom 162. A lip is provided at the bottom. The lip 163 has dimensions smaller than the internal diameter of the wing chamber 160. The second wing chamber 160 preferably has a central axis. Several openings 164 are provided into the chamber 160 from the front side 134 of the shell. The openings 164 are water permeable, and aid in alleviating any pressure from developing within the wing chamber.

The central axis of the central chamber 140, the first wing chamber 150 and the second wing chamber 160, respectively, are preferably parallel. The three chambers form a shell 130 having a rounded front 134 that is aerodynamic, and is free of sharp edges. The shell is relatively light weight in comparison to its volume. The rounded from 134 provides an ideal surface for the placement of advertisements, logos and of highly visible materials. The back 133 is generally flat, and accordingly presents a large surface area to distribute any force to the user, such as if a user was to land on their back.

Figure 8:
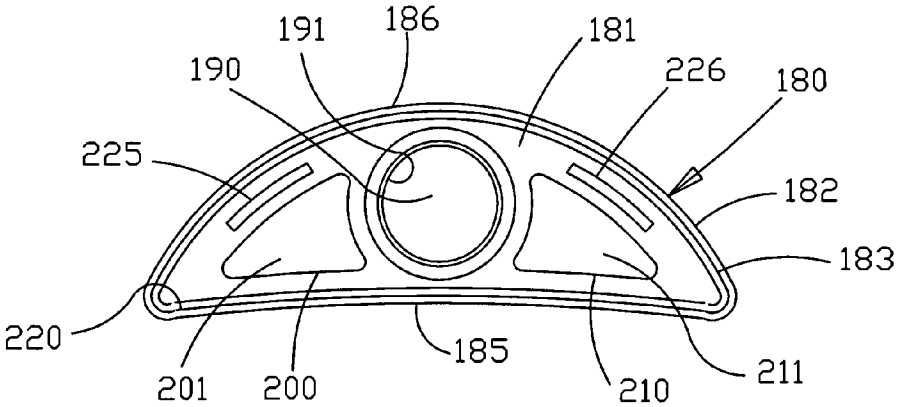
FIG. 8 is a bottom view of an alternative cap of the present invention.
Figure 9:
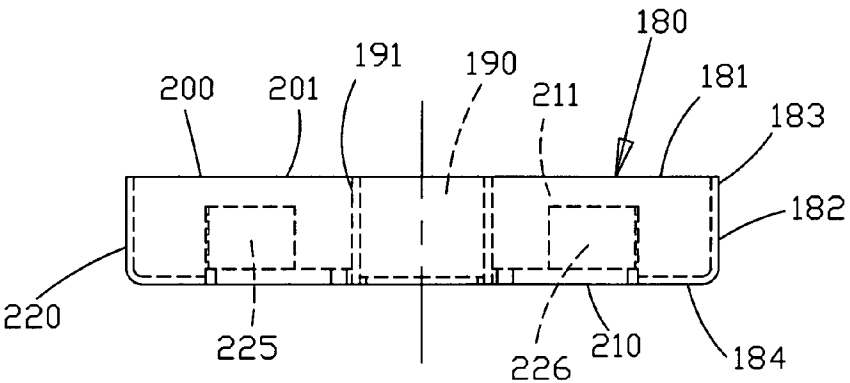
FIG. 9 is a side view of the alternative embodiment of the cap shown in FIG. 8.
Figure 10:
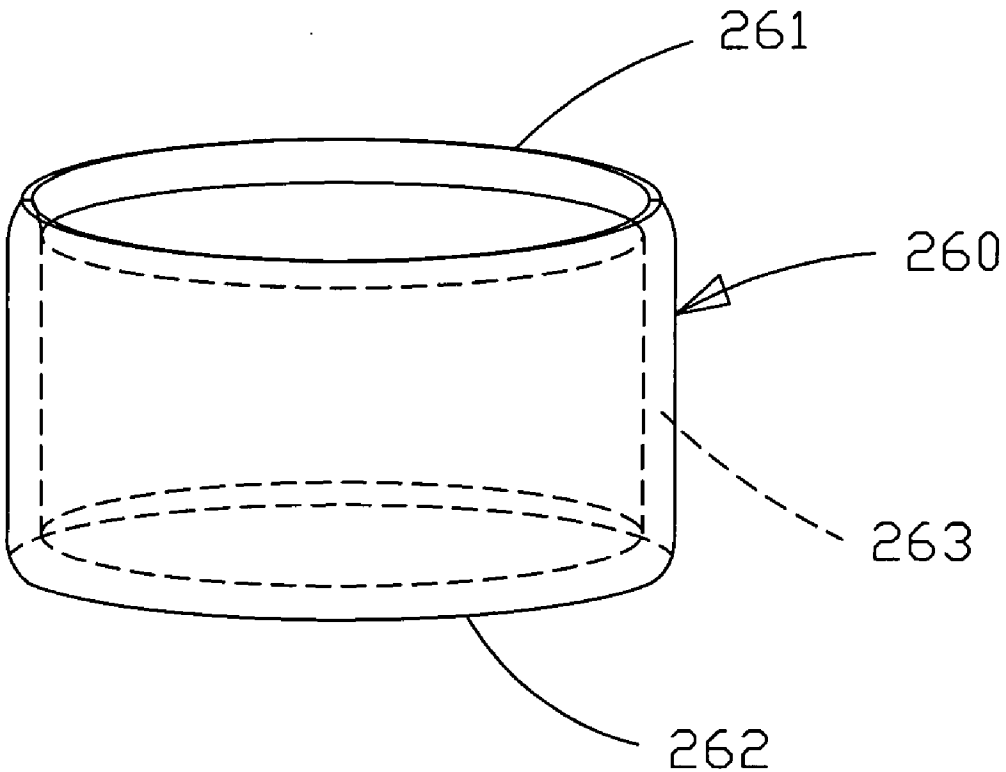
FIG. 10 is a perspective view of an embodiment of the weight of the present invention.

The shell further comprises a cap 180. The cap is best illustrated in FIGS. 8 and 9. While the cap 180 is described to be at the top 131 of the shell 130, it is understood that the cap could alternatively be located at the bottom of the shell without departing from the broad aspects of the present invention. The cap 180 has a top 181 with a perimeter 182 and a lip 183. The cap 180 further has a bottom 184, a back 185 and a front 185. The perimeter 182 is slightly larger than the external dimensions of the shell 130, such that the cap 180 can be placed at the top 131 of the shell 130.

A central hole 190 is provided through the cap 180. A lip 191 is around the central hole 190. The lip 191 defines the internal diameter of the central hole 190 of the cap 180. The central hole 190 is concentric with the central chamber 140 of the shell 130 when the cap is in place. The central hole 190 has an internal diameter that is preferably smaller than the internal diameter of the central chamber 140. In this regard the central hole 190 can act as a lip, and can have a similar or identical internal diameter as lip 143 at the bottom 142 of the central chamber 140.

Wing 200 is provided having opening 201. Wing 210 is also provided having hole 211. A sidewall 220 is further provided, and engages the outer perimeter of shell 130 when assembled. Tabs 225 and 226, respectively, are provided for frictionally securing the cap 180 on the shell 130. It is understood that the cap 180 is part of the shell 130, as the two are intended for use together. A fastener or adhesive can be used, if desired, to permanently join the cap 180 and the remainder of the shell 130.

The indicator 240 is preferably comprised of a tube 250 and a weight 260. The tube has a top 251, a bottom 252 and a sidewall 253. Air 254 is placed within the tube 250 by injecting air through a valve 255. The valve 255 can be at the top 251 of the tube 250. The weight 260 is preferably connected to the bottom 252 of the tube 250. The weight 260 has a top 261, a bottom 262 and a sidewall 263. The top 261 can be an open top that engages the outside of the wall 253 of the tube at and near the tube's bottom 252. The weight has an outside diameter that is smaller than the inside diameter of the central chamber 140, yet larger than the internal diameter of both the hole defined by lip 143 and hole defined by lip 183. In this regard, the weight 260 can move freely within the chamber under the forces of nature, yet is constrained from exiting the chamber. The tube 250 preferably has a generally round diameter to facilitate movement within the central chamber 140.

It will be appreciated that a light source, such as an LED indicator can be provided and located on the distal end of the indicator. The light can automatically turn on (either continuously or intermittently) when the tube extends a selected amount out of the shell. This can be accomplished by having the tube complete an electrical circuit when the tube reaches a certain point relative the shell.

The tube 250 is preferably flexible when inflated. In this regard, the tube 250 will bend under a strike condition, such as when another person hits the indicator. Yet, when the indicator is not under a strike condition, the tube sidewall 220 is sufficiently stiff to remain straight.

A life jacket 270 is further provided, and has a strap 271 that is used to secure the jacket to the user. It is understood that while the embodiment 120 is shown as integral with a jacket 270, the embodiment 120 may also be used independent of a jacket without departing from the broad aspects of the present invention.

Figure 11:
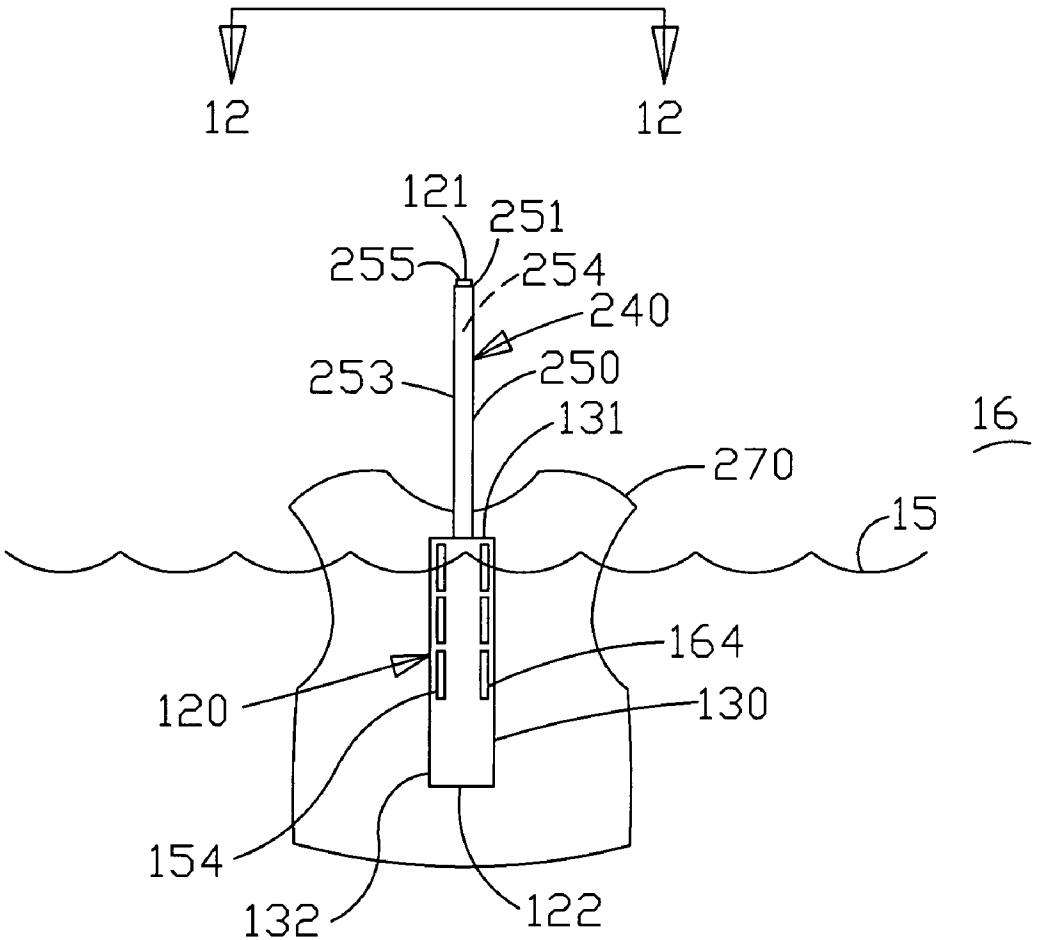
FIG. 11 is a side view of the alternative embodiment of the present invention illustrated in FIG. 6, showing the apparatus in the extended position.
Figure 12:
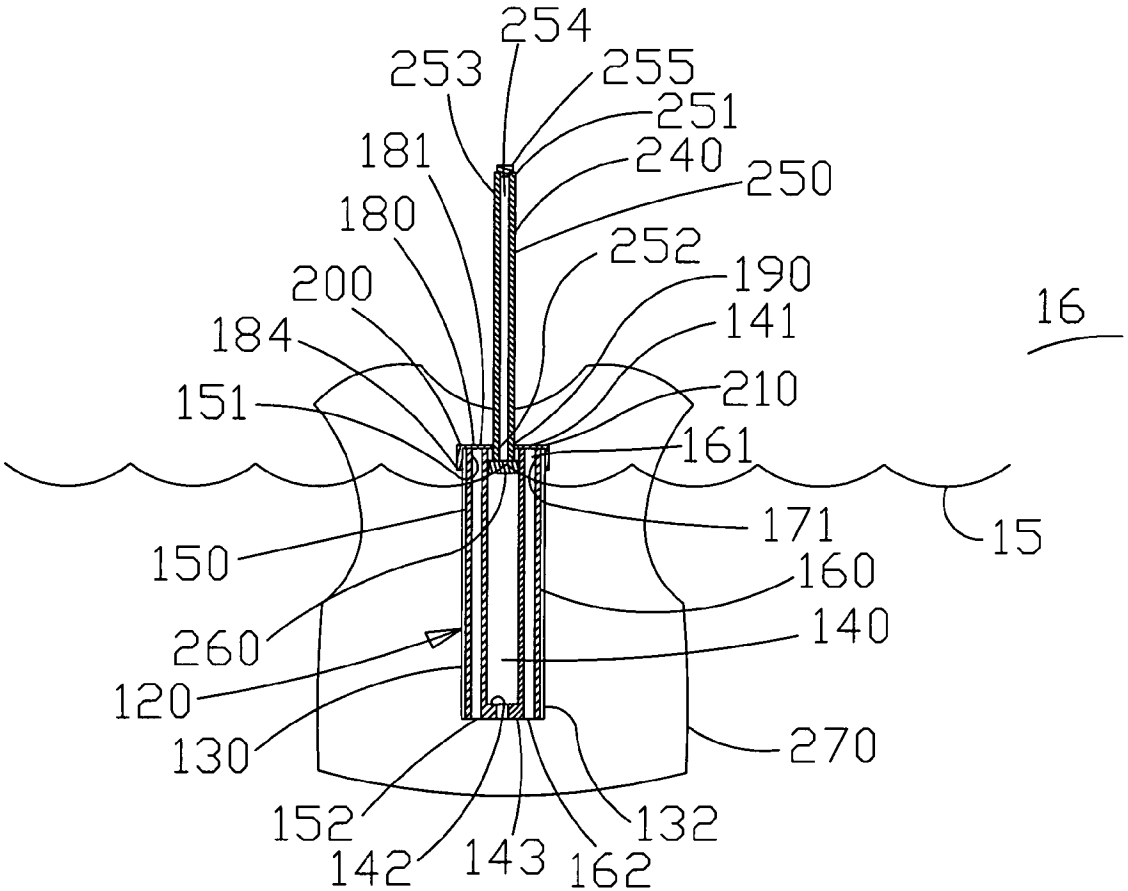
FIG. 12 is a cross-sectional view of the alternative embodiment shown in FIG. 11 and taken along line 12-12 in FIG. 11.
Figure 15:
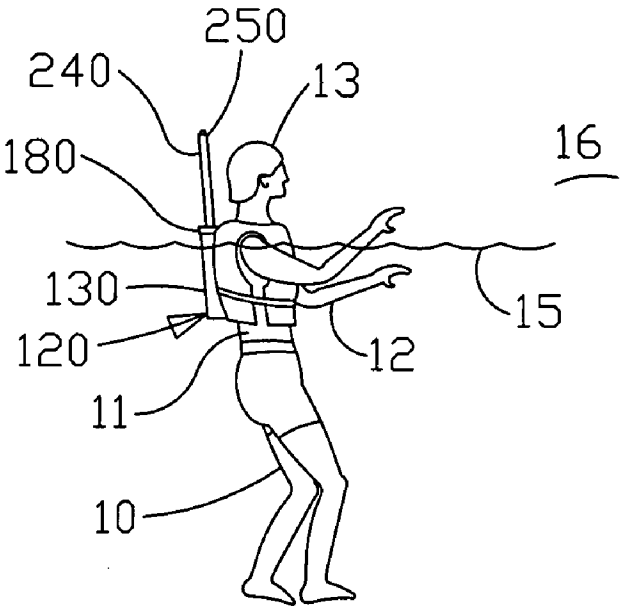
FIG. 15 is a side view of a person wearing the alternative embodiment of the present invention shown in FIG. 11 wherein the person is submerged in the water and the indicator is extended.

Looking now in particular to FIGS. 11, 12 and 15 the indicator 140 of the present invention is illustrated in an extended position, such as when the user is submerged in the water. In this regard, the buoyant force of the tube 250 is sufficient to overcome the force of gravity of the weight 260, and the tube 240 extends from the shell 130. The distance that the tube extends is limited by the depth that the tube is in the water. The lip 183 of the cap of the top of the shell 130 prevents the tube from fully exiting the shell 130 when the shell is fully submerged.

Figure 13:
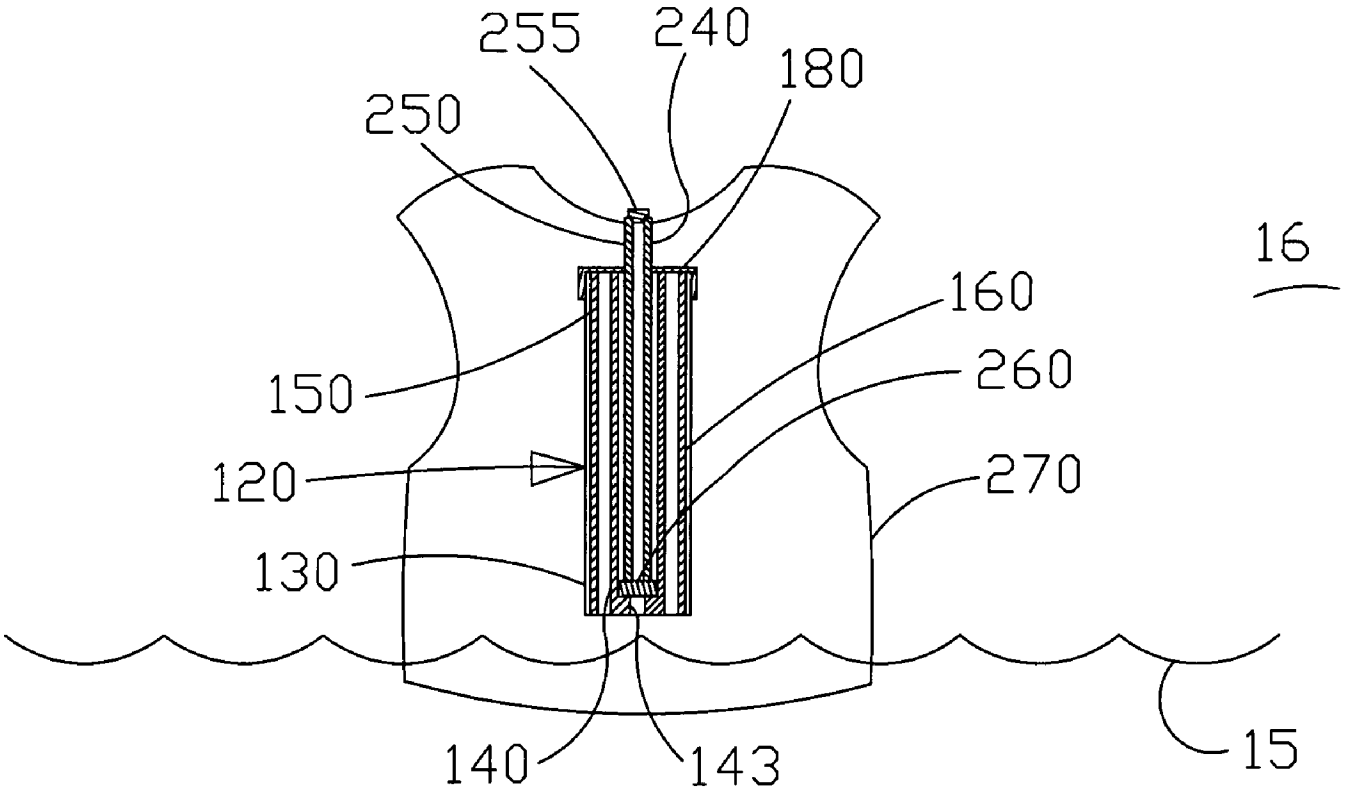
FIG. 13 is a side view of the alternative embodiment shown in FIG. 11, but in the retracted position.
Figure 14:
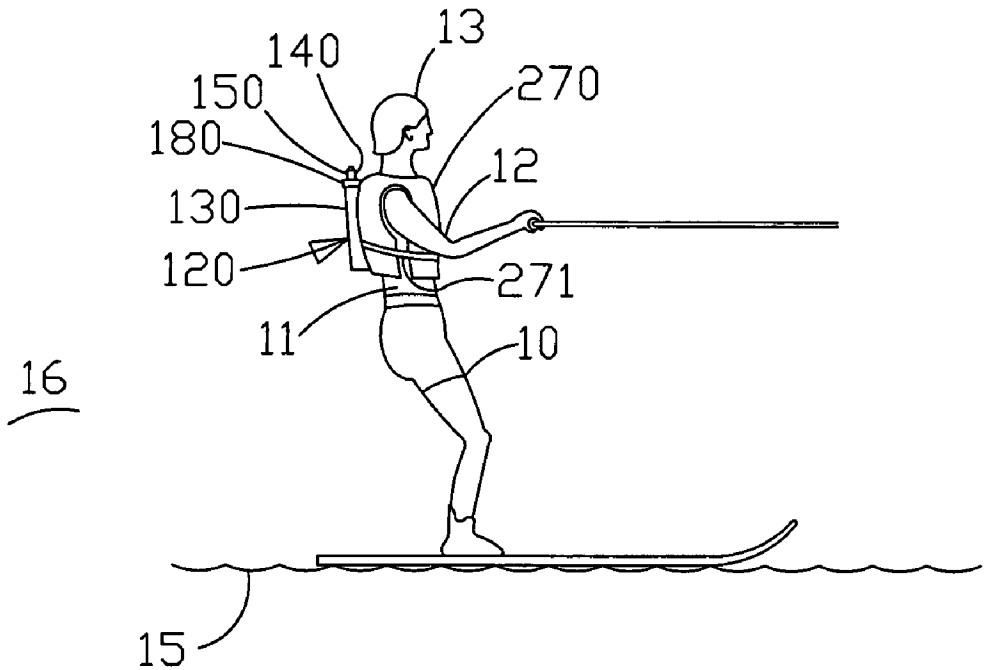
FIG. 14 is a side view of a person wearing the alternative embodiment of the present invention shown in FIG. 11 wherein the person is out of the water and the indicator is retracted.

Looking now to FIGS. 13 and 14, the indicator 140 of the present invention is illustrated in a retracted position. The weight 260 is sufficiently heavy in comparison to any upward forces acting of the tube 250 that the indicator remains fully retracted when the user is out of the water.

Thus it is apparent that there has been provided, in accordance with the invention, a water safety device that fully satisfies the objects, aims and advantages as set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. An apparatus for warning others of a person in the water, the apparatus comprising:

a shell having a central chamber with a central chamber top and a central chamber bottom;

an indicator having an indicator top and an indicator bottom, said indicator bottom being operable between said central chamber top and said central chamber bottom, said indicator having a weight at said indicator bottom, wherein when said apparatus is submerged in water, the buoyant forces acting on indicator overcome the force of gravity acting on said weight and force said indicator bottom to move away from said central chamber bottom, and wherein when said apparatus is not submerged in water, the force of gravity acting on said weight causes said indicator bottom to remain adjacent said central chamber bottom.

2. The apparatus of claim 1 wherein said indicator comprises a tube.

3. The apparatus of claim 2 wherein said tube has a valve, said valve allowing said tube to be inflated with air.

4. The apparatus of claim 2 wherein said tube is a flexible tube.

5. The apparatus of claim 1 wherein said weight acts within said central chamber.

6. The apparatus of claim 5 wherein:

said indicator comprises a tube having a tube outside diameter; and said central chamber has an internal diameter that is larger than said tube outside diameter, and has a central chamber central axis, whereby said tube is unrestrained from movement within said central chamber along directions parallel with said central chamber central axis.

7. The apparatus of claim 6 wherein said apparatus further comprises a first lip and a second lip, wherein:

said weight has an external diameter;

said central chamber top is constrained by said first lip wherein said first lip defines a hole having an internal diameter smaller than said external diameter of said weight;

said central chamber bottom is constrained by said second lip wherein said second lip defines a hole having an internal diameter smaller than said external diameter of said weight; and said weight is thereby constrained within said central chamber.

8. The apparatus of claim 7 wherein said shell comprises a cap, said cap providing one of said first lip and said second lip.

9. The apparatus of claim 8 wherein said cap comprises a tab and a sidewall, said tab and said sidewall engaging said shell there between.

10. The apparatus of claim 1, wherein said shell further comprises:

a first wing chamber; and a second wing chamber.

11. The apparatus of claim 10 wherein:

said first wing chamber has a first wing chamber central axis;

said second wing chamber has a second wing chamber central axis;

said central chamber has a central chamber central axis; and said first wing chamber central axis, said second wing chamber central axis and said central chamber central axis are generally parallel.

12. The apparatus of claim 10 wherein said several openings are provided through said shell and into said first wing chamber and said second wing chamber.

13. The apparatus of claim 1 wherein said shell has a front, wherein said front is generally rounded.

14. An apparatus for warning others of a person in the water, the apparatus comprising:

a shell having a central chamber with a central chamber top and a central chamber bottom;

an indicator having an indicator top and an indicator bottom, said indicator bottom being operable between said central chamber top and said central chamber bottom, said indicator comprising a tube, said tube having a substantially constant tube outside diameter, said tube further being free of objects with a diameter greater than said tube outside diameter at said indicator top;

wherein when said apparatus is submerged in water, the buoyant forces acting on said tube force said indicator bottom to move away from said central chamber bottom, and said tube being generally straight under no impact conditions and flexible under an impact condition and wherein when said apparatus is not submerged in water, the force of gravity acting on said tube causes said indicator bottom to remain adjacent said central chamber bottom.

15. The apparatus of claim 14 wherein said indicator further comprises a weight at said indicator bottom, said weight having a gravitational force smaller that the buoyant force of said tube when said tube is submerged in water.

16. The apparatus of claim 14 wherein said tube is inflatable.

17. The apparatus of claim 14 wherein said shell comprises:

a first lip at said central chamber bottom; and a second lip at said central chamber top, wherein said indicator bottom is constrained from exiting said central chamber by said first lip and said second lip.

18. An apparatus for warning others of a person in the water, the apparatus comprising:

a shell, said shell having a rounded front surface and comprising:

a central chamber with a central chamber top, a central chamber bottom, and a central chamber central axis;

a first wing chamber with a first wing chamber central axis; and a second wing chamber with a second wing chamber central axis; and an indicator having an indicator top and an indicator bottom, said indicator bottom being operable between said central chamber top and said central chamber bottom said indicator comprising a tube;

wherein when said apparatus is submerged in water, the buoyant forces acting on said tube force said indicator bottom to move away from said central chamber bottom, and wherein when said apparatus is not submerged in water, the force of gravity acting on said tube causes said indicator bottom to remain adjacent said central chamber bottom.

19. The apparatus of claim 18 wherein said indicator comprises a tube, said tube has a substantially constant tube outside diameter, said tube is free of objects with a diameter greater than said tube outside diameter at said indicator top, and said tube is generally straight under no impact conditions and flexible under an impact condition.

20. The apparatus of claim 18 wherein said indicator further comprises a weight at said indicator bottom, said weight having a gravitational force smaller that the buoyant force of said tube when said tube is submerged in water.

* * * * *